US006568537B1

(12) United States Patent
Schelkunov et al.

(10) Patent No.: US 6,568,537 B1
(45) Date of Patent: May 27, 2003

(54) COMPOSITION FOR THE FLOTATION OF USEFUL MINERALS PRODUCTS

(75) Inventors: SErgei Anatolievich Schelkunov, Moscow (RU); Oleg Anatolievich Malyshev, Pushkin (RU); Evgeny Mikhailovich Dubovsky, Karaganda (KZ); Yakov Yakovlevich Mamontov, Moscow (RU); Alexandr Anatolievich Maximov, Moscow (RU)

(73) Assignee: Zakrtoe Aktsionermoe Obschestvo "Strimer - Tsentr", Moscow (RU)

( * ) Notice: Subject to any disclaimer, the term of this patent is extended or adjusted under 35 U.S.C. 154(b) by 0 days.

(21) Appl. No.: 09/807,284

(22) PCT Filed: Aug. 10, 1999

(86) PCT No.: PCT/RU99/00280

§ 371 (c)(1),
(2), (4) Date: May 30, 2001

(87) PCT Pub. No.: WO01/10560

PCT Pub. Date: Feb. 15, 2001

(51) Int. Cl.[7] ..... B03D 1/008; B03D 1/02

(52) U.S. Cl. ..... 209/166; 252/61

(58) Field of Search ..... 252/61; 209/166

(56) References Cited

U.S. PATENT DOCUMENTS 2,611,485 A * 9/1952 Tveter
2,695,101 A * 11/1954 Booth et al.
3,675,773 A * 7/1972 Chemtob et al.
4,122,004 A * 10/1978 Harris
4,606,818 A * 8/1986 Keys

* cited by examiner

*Primary Examiner*—Thomas M. Lithgow
(74) *Attorney, Agent, or Firm*—Abel, Frayne & Schwab

(57) ABSTRACT

There is proposed a composition for the flotation of useful minerals, comprising a frother based on dimethyl (isopropenylethynyl)carbinol and a collector, the frother, for improving the technological flotation characteristics, having the following chemical composition, in wt. %: dimethyl (isopropenylethynyl)carbinol, 95.0–98.0; tetramethylbutynediol, 0.1–1.5; diisopropenylacetylene, 0.1–1.0; 2,5-dimethyl-1,4-hexadien-3-one, 1.5–2.5.

6 Claims, No Drawings

COMPOSITION FOR THE FLOTATION OF USEFUL MINERALS PRODUCTS

The present invention relates to the mineral dressing and may be used in the flotation of nonferrous metal ores, precious metal ores, and coal.

At present, for the flotation of coals, nonferrous and precious metal ores, it is known to use compositions comprising a frother and a collector. Frothers conventionally used in such cases are waste products of various chemical production processes, such as a waste from the production of synthetic rubber T-66 or bottoms after dimethyl dioxane rectification (Oxal T-80 according to Technical Specifications 38-103243-74) [1].

Collectors employed in the flotation of nonferrous metal ores usually are heteropolar sulfur-containing organic compounds: alkyl xanthates and aerofloats. In the flotation of coals polar and apolar collectors are used [2, 3]. Compositions of this type do not provide sufficiently high recovery characteristics for coal, nonferrous and precious metals. It is also known to use dimethyl(isopropenylethynyl)carbinol (DMIPEC) as a collector-frother in the flotation of coals [4].

A composition for the flotation of useful minerals, comprising a DMIPEC-based frother and a collector [5] is the most close in its technical essence to the composition according to the claimed invention. The known composition is disadvantageous in an insufficiently high recovery of the target product.

The proposed technical solution is directed to solving the problem of raising the level of recovering the target component in a wide range of temperatures and pH values of the pulp subjected to flotation.

For solving the posed problem, a composition is proposed for the flotation of useful minerals, comprising a DMIPEC-based frother and a collector, the DMIPEC-based frother further comprising tetramethylbutynediol (TMBD), diisopropenylacetylene (DIPA) and 2,5-dimethyl-1,4-hexadien-3-one (DMHDO), with the following ratio of the components (in wt. %):

| | |
|---|---|
| dimethyl(isopropenylethynyl)carbinol | 95.0–98.0 |
| tetramethylbutynediol | 0.1–1.5 |
| diisopropenylacetylene | 0.1–1.0 |
| 2,5-dimethyl-1,4-hexadien-3-one | 1.5–2.5 |

Said composition for the flotation of useful minerals may comprise as a collector alkyl xanthate, in this case the frother-to-collector weight ratio being 1:2–15, with the consumption of the composition being 20–200 grams per ton of an auriferous ore subjected to flotation.

The claimed composition for the flotation of useful minerals may comprise as a collector a butyl aerofloat, in this case the frother-to-collector weight ratio being 1:1.5–20, with the consumption of the composition being 15–150 grams per ton of a copper-containing ore subjected to flotation.

The claimed composition for the flotation of useful minerals may comprise as the collector an apolar collector based on saturated hydrocarbons, with the frother-to-collector weight ratio being 1:0.1–80.0 and the consumption of the composition being 25–300 grams per ton of coal subjected to flotation.

The claimed composition for the flotation of useful minerals may further comprise a frother based on saturated alcohols in an amount of 0.1–87.5%.

The claimed composition for the flotation of useful minerals may comprise, as the frother based on saturated alcohols, frother T-80: bottoms after dimethyl dioxane rectification.

As is known, frothers in the process of flotation act, mainly, at the liquid-gas interface, whereas collectors act at the liquid-solid interface. Therefore, in the flotation it is most effective to use compositions consisting of a frother and a collector. For each case the choice of the optimal formulation of the composition and the consumption thereof in the flotation, depends on a considerable number of factors, such as the chemical and mineralogical composition of the pulp to be subjected to flotation and of the flotation agents, and at present it cannot be reduced to unambiguous solutions. Ores to be subjected to flotation may be preliminarily conditioned by various methods for improving the flotability.

The mechanism of action of frothers is determined by their adsorption at the gas-liquid interface, so that it is possible to vary the coalescing capacity of air bubbles and the structural-mechanical properties of the envelopes of these bubbles, the bubble-free velocity, and the stability of the resulting froth.

In the presence of a frother the process of coalescence slows down sharply owing to the formation of an oriented layer of frother molecules at the liquid-gas interface. The shape of the air bubbles in this case is close to spherical, and this contributes to an increase of air content in the pulp and, consequently, to a higher effectiveness of the flotation.

The effectiveness of the action of frothers, other things being equal, depends on the temperature and pH, since these flotation parameters change the solubility of the frother and the mobility of its molecules in the pulp, this leading to changes in the rate of leveling the density of the adsorption layer on the bubbles and, thereby, to changes in their elasticity and in the froth strength. The most effective way of stabilizing froth formation under industrial conditions which are characterized by variations of a rather wide range of parameters, is to use a mixture of frothers or frothers of a complex composition.

Frothers, being surfactants at the liquid-solid interface as well, may also actively influence the hydrophobization of the surface and the flotability of many of useful minerals.

The reasons for changes in the flotability of minerals under the action of frothers can be:

- an increase in the degree of hydrophobicity of the mineral surface owing to the hydrocarbon radical of the adsorption frother, whose polar group forms chemical, hydrogen bonds with the atoms of the surface or is retained by the dipole interaction forces;
- an increase in the dispersity of a collector in the pulp, improving its collecting action.

The molecules of the collector employed also affect all these factors simultaneously, and this leads to a sophisticated complex of physicochemical interactions in the process of flotation. An inappropriate selection of the frother-collector composition may lead to a lower degree of recovering the ore subjected to flotation, to an increased consumption of flotation agents, to a high sensitivity to the ore composition, flotation temperature, and pH of the medium.

The presence of a frother with molecules of different chemical nature in the formulation of the composition claimed according to present technical solution makes it possible to enhance the flotation properties of said composition (over the prototype), while the chemical composition fixed with sufficient rigidity stabilizes these properties. In some cases the claimed composition may be used in a mixture with other frothers for increasing the degree of recovering the target product. This makes it possible to employ the claimed composition for a wide range of useful minerals, such as nonferrous metal ores, noble metal ores and coals. For obtaining the best results, one should choose optimal particular flotation conditions: type of the collector, frother:collector ratio, consumption of the composition for the flotation, etc.

The essence of the present technical solution is illustrated by particular examples of carrying out thereof.

EXAMPLE 1

Auriferous ore from the Akbakai ore dressing complex (the Republic of Kazakhstan; was crushed down to particles smaller than 0.074 mm in diameter in an amount of 85 wt. %. Flotation was carried out on a 240 FL-A laboratory machine with a 3-liter capacity flotation chamber. The content of ore in the pulp was 20%, flotation time was 3 minutes. The results of tests are presented in Table 1.

EXAMPLE 2

Copper-containing ore from the Kounrad quarry (Balkhash, the Republic of Kazakhstan) was prepared for and subjected to flotation as described in Example 1, except for the composition of floating agents. The results of tests are presented in Table 2.

EXAMPLE 3

Coal slurry with ash content of 13.25% from the Byelovskaya coal-preparation plant (Kuznetsk Coal Basin, Russia) was subjected to flotation at the pulp density of 100 g/l. The results of tests are presented in Table 3.

EXAMPLE 4

Copper-containing ore from the Kounrad quarry (Balkhash, the Republic of Kazakhstan) was prepared for and subjected to flotation as described in Example 2, except for the composition of floating agents. The results of tests are presented in Table 4.

As it follows from the results of the flotation, in which compositions for the flotation of nonferrous metal ores, noble metal ores and coal were used in accordance with the present technical solution, their use makes it possible to increase the recovery of useful minerals over the prototype.

REFERENCES

1. A. A. Abramov, Flotation Methods of Concentration, Moscow, "Nedra" Publishers, 1993, pp. 199–210 (in Russian).
2. G. A. Pikatt-Ordynskii, Flotation Concentration Technology, Moscow, "Nedra" Publishers, 1972 (in Russian).
3. S. M. Mitrofanov, Selective Flotation, Moscow, GNTI, 1958, pp. 73–75 (in Russian).
4. USSR Inventor's Certificate No. 937024.
5. Preliminary Patent of the Republic of Kazakhstan No. 7383.

TABLE 1

| | Flotation conditions | | | | Degree | |
|---|---|---|---|---|---|---|
| Nos. | Type of frother | Consumption of frother, g/t | Flotation temperature, ° C. | pH of the medium | of Au recovery, % | Notes |
| 1. | DMIPEC | 70 | 20 | 6–7 | 84.7 | Prototype |
| 2. | DMIPEC | 70 | 10 | 6–7 | 82.5 | Prototype |
| 3. | DMIPEC | 70 | 5 | 5–6 | 80.2 | Prototype |
| 4. | A | 70 | 20 | 6–7 | 94.6 | According to the technical solution |
| 5. | B | 70 | 10 | 6–7 | 92.7 | Same |
| 6. | C | 70 | 5 | 5–6 | 93.4 | Same |

Comments:
A — composition of frother, wt. %: DMIPEC, 95.0; TMBD, 1.5; DIPA, 1.0; DMHDO, 2.5.
B — composition of frother, wt. %: DMIPEC, 98.0; TMBD, 0.1; DIPA, 0.1; DMHDO, 1.8.
C — composition of frother, wt. %: DMIPEC, 97.1; TMBD, 0.8; DIPA, 0.6; DMHDO, 1.5.

TABLE 2

| | Flotation conditions | | Composition for flotation | | | | |
|---|---|---|---|---|---|---|---|
| Nos. | ° C. | pH | Frother | Collector | Frother/collector weight ratio | Consumption of composition, g/t of floated ore | Degree of Cu recovery, % |
| 1. | 20 | 6–7 | DMIPEC | Butyl | 1:4 | 200 | 82.3 |
| 2. | 5 | 5–6 | DMIPEC | xanthate | 1:4 | 200 | 77.8 |
| 3. | 20 | 6–7 | Composition according to the present technical solution | Butyl xanthate | 1:4 | 200 | 94.3 |
| 4. | 5 | 5–6 | Same | Same | 1:4 | 200 | 92.9 |

TABLE 2-continued

| Nos. | Flotation conditions ° C. | Flotation conditions pH | Composition for flotation: Frother | Composition for flotation: Collector | Composition for flotation: Frother/collector weight ratio | Composition for flotation: Consumption of composition, g/t of floated ore | Degree of Cu recovery, % |
|---|---|---|---|---|---|---|---|
| 5. | 20 | 6–7 | DMIPEC | Butyl xanthate | 1:2 | 20 | 73.0 |
| 6. | 5 | 5–7 | DMIPEC | Same | 1:2 | 20 | 73.4 |
| 7. | 20 | 6–7 | Composition according to the claimed technical solution | Same | 1:2 | 20 | 82.5 |
| 8. | 5 | 5–6 | Same | Same | 1:2 | 20 | 82.0 |
| 9. | 20 | 6–7 | DMIPEC | Butyl | 1:15 | 160 | 80.7 |
| 10. | 5 | 5–6 | DMIPEC | xanthate | 1:15 | 160 | 76.9 |
| 11. | 20 | 6–7 | Composition according to the claimed technical solution | Same | 1:15 | 160 | 88.2 |
| 12. | 5 | 5–6 | Same | Same | 1:15 | 160 | 87.7 |

Note: In Examples 3, 4 the composition of the frother is, in wt. %: (I), 95.0; (II), 1.5; (III), 1.0; (IV), 2.5; in Examples 7, 8: (I), 98.0; (II), 0.1; (III), 0.1; (IV), 1.8; in Examples 11, 12: (I), 97.3; (II), 0.7; (III), 0.5; (IV), 1.5. Where (I) is DMIPEC; (II) is DIPA; (III) is TMBD; (IV) is DMHDO.

TABLE 3

| Nos. | Flotation conditions, ° C. | Composition for flotation: Frother | Composition for flotation: Collector | Composition for flotation: Frother/collector weight ratio | Composition for flotation: Consumption of composition, g/t of floated coal | Degree of coal recovery, % |
|---|---|---|---|---|---|---|
| 1. | 20 | DMIPEC | Stove fuel | 1:0.1–80 | 25 | 63.4 |
| 2. | 5 | DMIPEC | | Same | 25 | 67.8 |
| 3. | 20 | Composition according to the present technical solution | Same | 1:0.1 | 25 | 72.3 |
| 4. | 5 | Same | Same | Same | Same | 75.2 |
| 5. | 20 | DMIPEC | Same | 1:30 | 2500 | 85.4 |
| 6. | 5 | DMIPEC | Same | Same | Same | 83.7 |
| 7. | 20 | Composition according to the claimed technical solution | Same | Same | Same | 91.8 |
| 8. | 5 | Same | Same | Same | Same | 90.7 |
| 9. | 20 | DMIPEC | Same | 1:80 | 3500 | 83.0 |
| 10. | 20 | DMIPEC | Same | Same | Same | 81.1 |
| 11. | 5 | Composition according to the claimed technical solution | Same | Same | Same | 85.5 |
| 12. | 20 | Same | Same | Same | Same | 86.7 |

Note: In Examples 3, 4, 7, 8, 11, 12 the frother composition is (in wt. %): DMIPEC, 95.0; TMBD, 1.5; DIPA, 1.0; DMHDO, 2.5.

TABLE 4

| | Flotation conditions | | Composition for flotation | | | | |
|---|---|---|---|---|---|---|---|
| Nos. | ° C. | pH | Type of frother | Type of collector | Frother/ collector weight ratio | Consumption of composition, g/t of ore | Degree of copper recovery, % |
| 1. | 20 | 7–8 | T80:DMIPEC 4:1 | Butyl xanthate | 2:1 | 60 | 87.3 |
| 2. | 5 | 5–6 | Same | Same | Same | Same | 87.2 |
| 3. | 20 | 7–8 | T80:K 1:999 | Same | Same | | 90.1 |
| 4. | 5 | 5–6 | Same | Same | Same | Same | 90.9 |
| 5. | 20 | 7–8 | T80:K 4:1 | Same | Same | Same | 91.2 |
| 6. | 5 | 5–6 | Same | Same | Same | Same | 91.1 |
| 7. | 20 | 7–8 | T80:K 7:1 | Same | Same | Same | 87.4 |
| 8. | 5 | 5–6 | Same | Same | Same | Same | 87.3 |

Note: K is the composition according to the present technical solution, having the following composition, in wt. %: DMIPEC, 95.0; TMBD, 1.5; DIPA, 1.0; DMHDO, 2.5.

What is claimed is:

1. A composition for the flotation of useful minerals, comprising a frother based on dimethyl(isopropenylethynyl) carbinol and a collector, characterized in that the frother based on dimethyl(isopropenylethynyl)carbinol has the following chemical composition, in wt. %:

| | |
|---|---|
| dimethyl(isopropenylethynyl)carbinol | 95.0–98.0 |
| tetramethylbutynediol | 0.1–1.5 |
| diisopropenylacetylene | 0.1–1.0 |
| 2,5-dimethyl-1,4-hexadien-3-one | 1.5–2.5. |

2. A composition for the flotation of useful minerals according to claim 1, characterized in that as the collector it comprises alkyl xanthate, and the weight ratio of the frother to the collector is 1:2–15, with the consumption of the composition being 20–200 grams per ton of an auriferous ore subjected to flotation.

3. A composition for the flotation of useful minerals according to claim 1, characterized in that as the collector it comprises an alkyl aerofloat, and the weight ratio of the frother to the collector is 1:1.5–20.0, with the consumption of the composition being 15–150 grams per ton of a copper-containing ore subjected to flotation.

4. A composition for the flotation of useful minerals according to claim 1, characterized in that as the collector it comprises an apolar collector based on saturated hydrocarbons, and weight ratio of the frother to said apolar collector is 1:0.1–80.0, with the consumption of the composition being 25–3500 grams per ton of coal subjected to flotation.

5. A composition for the flotation of useful minerals according to claim 1, characterized in that it further comprises a frother based on saturated alcohols in an amount of 0.1–87.5%.

6. A composition for the flotation of useful minerals according to claim 5, characterized in that as the frother based on saturated alcohols it comprises a frother comprising bottoms after dimethyl dioxane rectification.

* * * * *